US005602635A

United States Patent [19]

Domoto et al.

[11] Patent Number: 5,602,635

[45] Date of Patent: Feb. 11, 1997

[54] RAPID WAKE UP FUSER

[75] Inventors: Gerald A. Domoto, Briarcliff Manor; Richard B. Lewis, Williamson, both of N.Y.

[73] Assignee: Xerox Corporation, Stamford, Conn.

[21] Appl. No.: 584,791

[22] Filed: Jan. 11, 1996

[51] Int. Cl.[6] ..... G03G 15/20

[52] U.S. Cl. ..... 399/328; 399/336

[58] Field of Search ..... 355/282, 285, 355/288, 290

[56] References Cited

U.S. PATENT DOCUMENTS

| | | | |
|---|---|---|---|
| 3,452,181 | 6/1969 | Stryjewski | 355/285 |
| 3,948,214 | 4/1976 | Thettu | 118/60 |
| 4,355,225 | 10/1982 | Marsh | 219/216 |
| 4,435,069 | 3/1984 | Sato | 355/286 |
| 4,563,073 | 1/1986 | Reynolds | 355/284 |
| 4,724,303 | 2/1988 | Martin et al. | 219/216 |
| 5,087,946 | 2/1992 | Dalal et al. | 355/285 |
| 5,390,013 | 2/1995 | Snelling | 355/285 |

FOREIGN PATENT DOCUMENTS 6-35354 2/1994 Japan .

7-121041 5/1995 Japan .

*Primary Examiner*—Nestor R. Ramirez
*Attorney, Agent, or Firm*—Kevin R. Kepner

[57] ABSTRACT

An apparatus for fusing images to a sheet. A fuser device is provided using a transparent fusing roll having an internal heating device which focuses the energy to a narrow area of the roll adjacent the nip formed with a pressure roll. A transparent fuser roll is used in a pressure nip fusing system to take advantage of the quick response of a focused lamp system while at the same time yielding the desirable image quality attributes of the pressure nip in two roll fusing. The focused lamp is completely enclosed and the heated region of the paper is within the nip contact region so there exists no possibility of igniting the paper. A lateral temperature smoothing device, or leveling roll, is also provided to maintain a fairly uniform temperature axially across the fuser roll. This is particularly useful for a wide fuser roll, i.e., 17 inches, through which narrower paper, i.e., 11 or 14 inches, is passing to prevent the ends of the fuser roll which do not contact the paper from overheating. A quick start up from cold start is possible so that no standby power is required.

12 Claims, 6 Drawing Sheets

RAPID WAKE UP FUSER

This invention relates generally to a fusing system, and more particularly concerns a rapid wake up fusing member which provides a very uniform fusing temperature along its axis and a high efficiency for fusing images to a sheet.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

Most current fusers use conduction as the main heat transfer mechanism to melt toner to paper. Such systems suffer from non-uniform axial temperature distributions when various paper widths are fed through the fusing nip. Some of these problems are addressed through shaping of the heat lamp axial profile or by using multiple heat lamps to allow control of the axial heating profile.

Because axial heat transfer is controlled by conduction, most fusers have difficulty with transport of energy in the axial direction Invariably, this leads to overheating of the rubber layers which is a major cause for reduced fuser life.

In order to fuse toner material permanently onto a support surface by heat, it is usually necessary to elevate the temperature of the toner material to a point at which the constituents of the toner materials coalesce and become tacky. This heating causes the toner to flow to some extent into the fibers or pores of the support member. Thereafter, as the toner material cools, solidification of the toner material causes the toner material to become firmly bonded to the support member.

The use of thermal energy for fixing toner images onto a support member is well known. Several approaches to thermal fusing of electroscopic toner images have been described in the prior art. These methods include providing the application of heat and pressure substantially concurrently by various means, for example, a roll pair maintained in pressure contact, a flat or curved plate member in pressure contact with a roll, and a belt member in pressure contact with a roll.

Prior fusing systems have been effective in providing the fusing of many copies in relatively large fast duplicating machines, in which the use of standby heating elements to maintain the machine at or near its operating temperature can be justified. However, there is a continuing need for an instant-on fuser which requires no standby power for maintaining the fuser apparatus at a temperature above the ambient. It is known to use a positive characteristic thermistor having a self temperature controlling property as a heater for a heating roller. The roller is regulated to a prescribed temperature by a heating control temperature detection element. It is also known to employ radiation absorbing materials for the fuser roll construction to effect faster warm-up time and to use an instant-on radiant fuser apparatus made of a low mass reflector thermally spaced from a housing, with the housing and the reflector together forming a conduit for the passage of cooling air therein. It is also known to use a cylindrical member having a first layer made of elastomeric material for transporting radiant energy, a second layer for absorbing radiant energy, and a third layer covering the second layer to effect a good release characteristic on the fuser roll surface. The fuser roll layers are relatively thin and have an instant-start capability. It is also known to use an instant-on fuser having a core of metal or ceramic supporting a fuser roller, and including a heat insulating layer, an electrically insulating layer and a protective layer formed on the outer circumference of the core.

Radiant fusers can be rapid turn on because the energy from the lamp is deposited directly into the toner layer raising its temperature to that required for fusing to the paper. Radiant fusers, however, suffer from the fact that no pressure is applied to force the molten toner into the paper fibers and no control of gloss is possible. Additionally, radiant fusers suffer from the potential fire hazard should a jam occur or should the fuser be of too high a temperature. Roll fusers with pressure nips yield better fix, as well as control gloss. However, roll fusers are difficult to turn on rapidly due to the overhead of heating the entire fuser roll such that the surface temperature reaches approximately twice the temperature required to adequately affix toner to the paper. When the hot fuser roll surface contacts the cold paper, the interface (toner) reaches a temperature approximately mid way between the two temperatures.

The following disclosures may be relevant to various aspects of the present invention:

U.S. Pat. No. 5,390,013 Inventor: Snelling, Christopher Issue Date: Feb. 14, 1995

U.S. Pat. No. 5,087,946 Inventor: Dalai, et al. Issue Date: Feb. 11, 1992

U.S. Pat. No. 4,724,303 Inventor: Martin, et al. Issue Date: Feb. 9, 1988

U.S. Pat. No. 4,563,073 Inventor: Reynolds, Scott D. Issue Date: Jan. 7, 1986

U.S. Pat. No. 4,355,225 Inventor: Marsh, Dana G. Issue Date: Oct. 19, 1982

U.S. Pat. No. 3,948,214 Inventor: Thettu, Raghulinga R. Issue Date: Apr. 6, 1976

The relevant portions of the foregoing disclosures may be briefly summarized as follows:

U.S. Pat. No. 5,390,013 describes an ultrasonic fuser for fixing toner images to substrates. The fuser uses an acoustic transducer or resonator in the form of an ultrasonic welding horn and a viscoelastic member. Toner images carried on a substrate are moved between the resonator and the viscoelastic member. Heat energy is created both in the toner particles forming the images in the viscoelastic member. The heat energy created in the viscoelastic member is transferred to the toner images through intimate contact therewith and the heat generated serves to elevate the toner to its fusing temperature.

U.S. Pat. No. 5,087,946 discloses a fuser roll including the hollow cylinder having a relatively thin wall, the cylinder being of plastic composition, reinforced with a conductive fiber fill. The plastic composition has a resistivity between 0.5 and 0.05 ohms centimeters, the cylinder having an outside and an inside surface and enclosing ambient air, a backup roll disposed in an engaging relationship with the outside surface of the hollow cylinder defines the nip. A heating element is disposed within the relatively thin wall, the heating element being conductive fiber filler and the conductive fiber filler also providing mechanical reinforcement of the hollow cylinder. An additive is part of the plastic composition and provides a release layer on the outside surface of the cylinder.

U.S. Pat. No. 4,724,303 discloses an instant-on fuser having a cylindrical relatively thin metal cylinder supporting a resistance heating foil or printed circuit secure don the inside surface of the cylinder by a high temperature adhesive. The interior of the cylinder tube is filled with air. The heating foil or printed circuit is carried on a fiberglass substrate and the heating element is connected to electrical leads extending to caps on the ends of the cylindrical support. The relatively low thickness, low mass fuser and high temperature materials permit a relatively fast instant-on fuser.

U.S. Pat. No. 4,563,073 describes a heat and pressure fusing apparatus in which the heat and pressure functions are separated such that the heat and pressure are effected at different locations on a thin flexible belt forming the toner contacting surface. The pressure roll cooperates with the stationery mandril to form a nip through which the belt and copy substrate pass simultaneously. The belt is heated such that by the time it passes through the nip its temperature, together with the applied pressure, is sufficient for fusing the toner images passing therethrough.

U.S. Pat. No. 4,355,225 discloses an instant-on radiant fuser apparatus for fusing toner images in a printing machine. The radiant fuser is made of a low mass reflector thermally spaced from a housing, with the housing and reflector together forming a conduit for the passage of cooling air therein. A low mass platen is provided which is constructed to achieve operating temperature conditions in a matter of a few seconds without the use of any standby heating device.

U.S. Pat. No. 3,948,214 describes a fuser apparatus which fuses toner images onto support material by heat and pressure including an instantly heated fuser roll and pressure backup roll having an elastomeric surface. The fuser roll has a cylindrical member made of quartz or other material which transmits radiant energy from a source located on the interior of the cylindrical member. The cylindrical member has a first layer made of elastomeric material which transmits radiant energy. The first layer is covered with a second layer of material which absorbs radiant energy. A third layer of material covers the second layer of heat absorbing material to effect a good toner release characteristic on the fuser roll surface. The fuser roll layers are relatively thin and have an instant start capability to fuse toner images onto support material such as paper.

In accordance with one aspect of the present invention, there is provided an apparatus for fusing images to a substrate. The apparatus comprises a pressure member and a heated transparent fusing member adjacent the pressure member and forming a nip therewith, the fusing member heated so that the heat energy is focused in a relatively narrow area adjacent the nip.

Pursuant to another aspect of the present invention, there is provided an electrophotographic printing machine in which images are fused to a substrate. The machine comprises a pressure member and a heated transparent fusing member adjacent the pressure member and forming a nip therewith, the fusing member heated so that the heat energy is focused in a relatively narrow area adjacent the nip.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
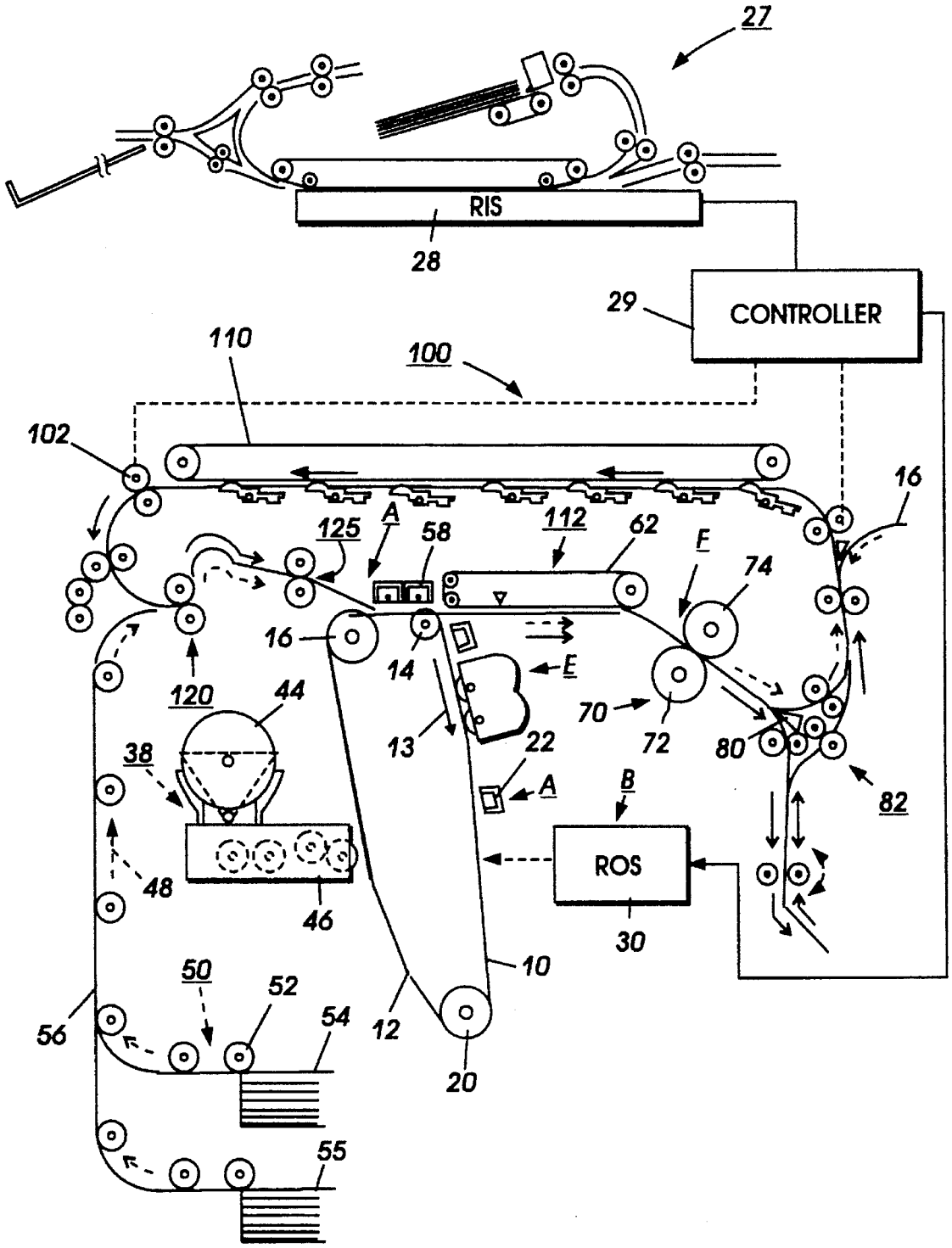
FIG. 1 is a schematic elevational view of an electrophotographic printing machine incorporating the fusing system of the invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the fuser of the present invention may be employed in a wide variety of devices and is not specifically limited in its application to the particular embodiment depicted herein.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, 13, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. Preferably, a nine facet polygon is used. The ROS illuminates the charged portion of photoconductive belt 10 at a resolution of about 300 or more pixels per inch. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into vertical transport 56. Vertical transport 56 directs the advancing sheet 48 of support material into registration transport 57 past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The fuser system will be described in more detail with reference to FIGS. 2–8 inclusive.

The sheet then passes through fuser 70 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 16. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 16.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc.. The control of all of the exemplary systems heretofore described may be accomplished by conventional control switch inputs from the printing machine consoles selected by the operator. Conventional sheet path sensors or switches may be utilized to keep track of the position of the document and the copy sheets.

A system incorporating the rapid turn on of radiant fusers and the pressure nip of roll fusers is simulated and shown to have 0.2 of a second warm up and exhibits no temperature droop, which is characteristic of conventional roll fusers. The underlying idea is to utilize a fuser roll core which is transparent to the lamp radiation and to focus lamp radiation to a narrow beam within the nip and at or near the interface between the fuser roll and the paper. This will cause heating of the toner layer in the nip. Approximately half the energy will be deposited in the toner paper and half by conduction into the surface of the moving transparent roll when everything begins at room temperature. As the roll heats up, more of the energy will be deposited into the toner, less into the roll, requiring less heat from the lamp for a given toner interface temperature.

Figure 2:
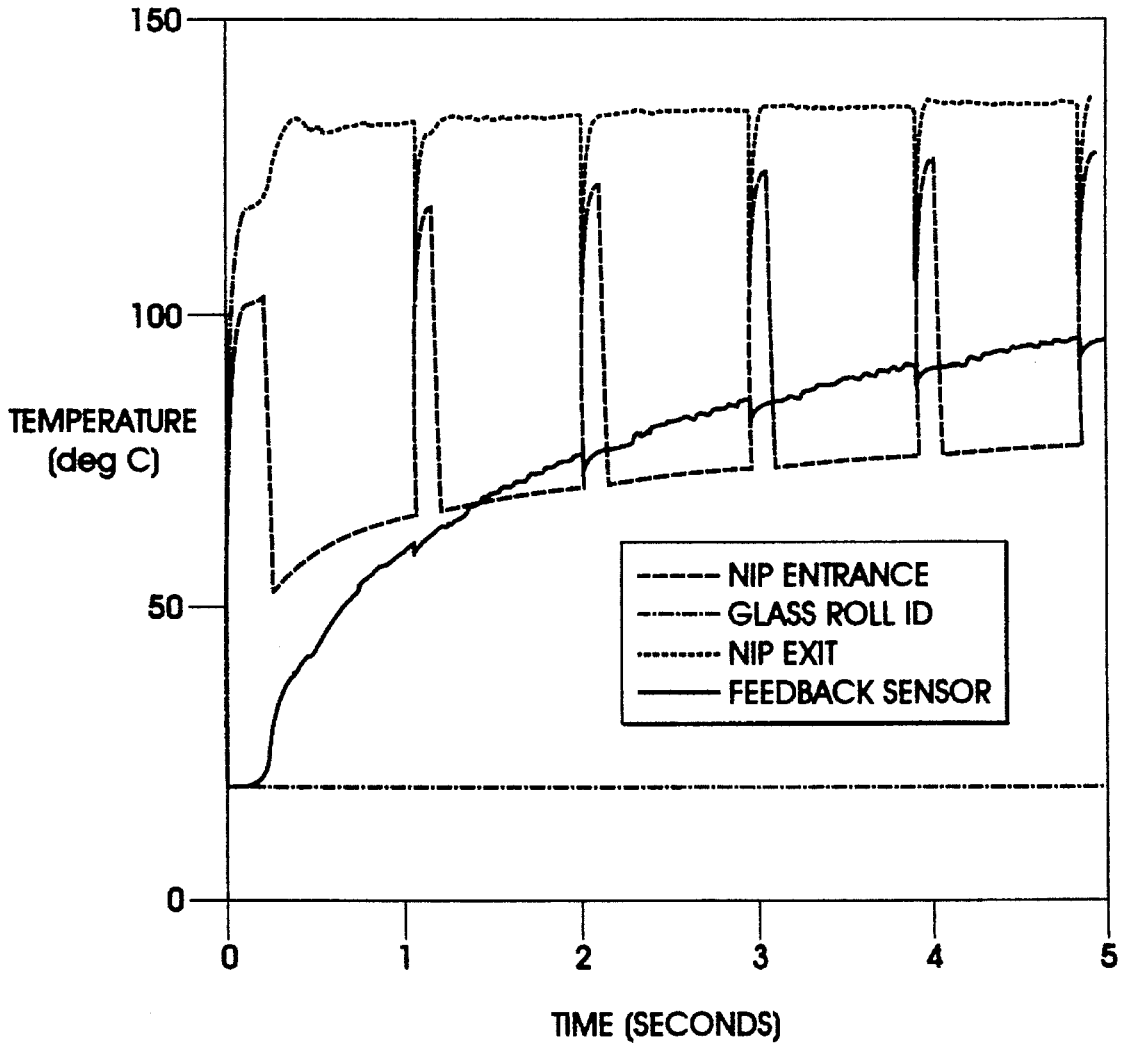
FIG. 2 is is a graph illustrating the temperature versus time at selected nodes of the fuser.
Figure 3:
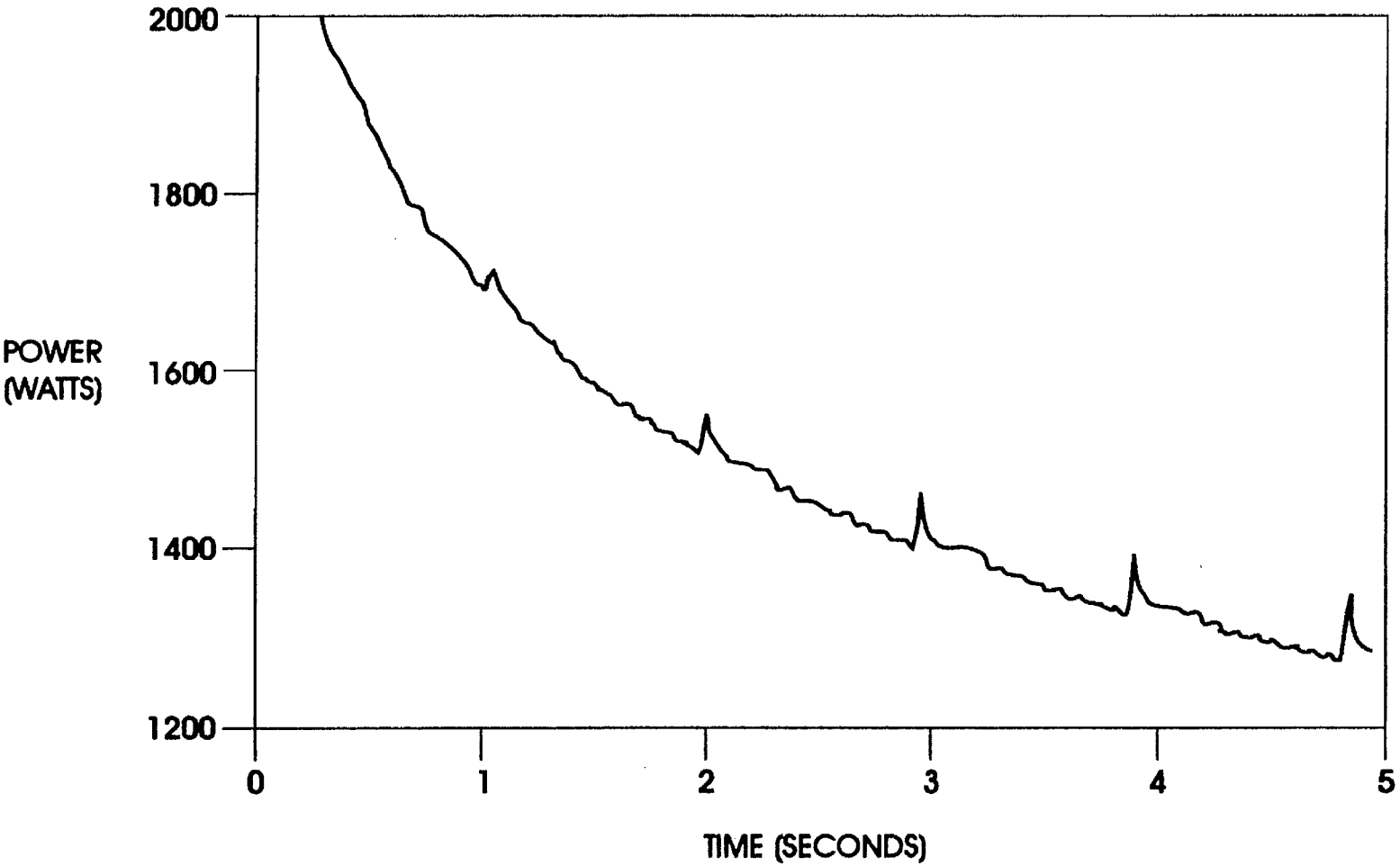
FIG. 3 is a graph illustrating the fuser power requirements versus time.

A simulation was performed of this system for a process speed of 10 inches per second, A one inch diameter infrared transmitting glass roll, with a half inch diameter hole, was assumed. This roll may require a thin absorbing Teflon or Viton coating, a transparent low conductivity silicone ribber layer for conformability and provisions for oiling to ensure good release. The heat from the lamp is assumed to be focused through the infrared transmitting glass and silicone layer to a narrow strip 0.5 centimeters in width in a thin absorbing surface layer of the roll adjacent to the nip. Temperatures are computed for the toner paper interface at the nip entrance and at the nip exit. The warm up was assumed to occur with the fuser roll in contact with the pressure roll and required 0.2 seconds from cold start with everything at room temperature. Temperature versus time is illustrated in FIG. 2 for a run of five sheets with intercopy gaps. A proportional controller was used with the sensor placed on the fuser roll surface ahead of the nip. The power required versus time is shown in FIG. 3.

Figure 6:
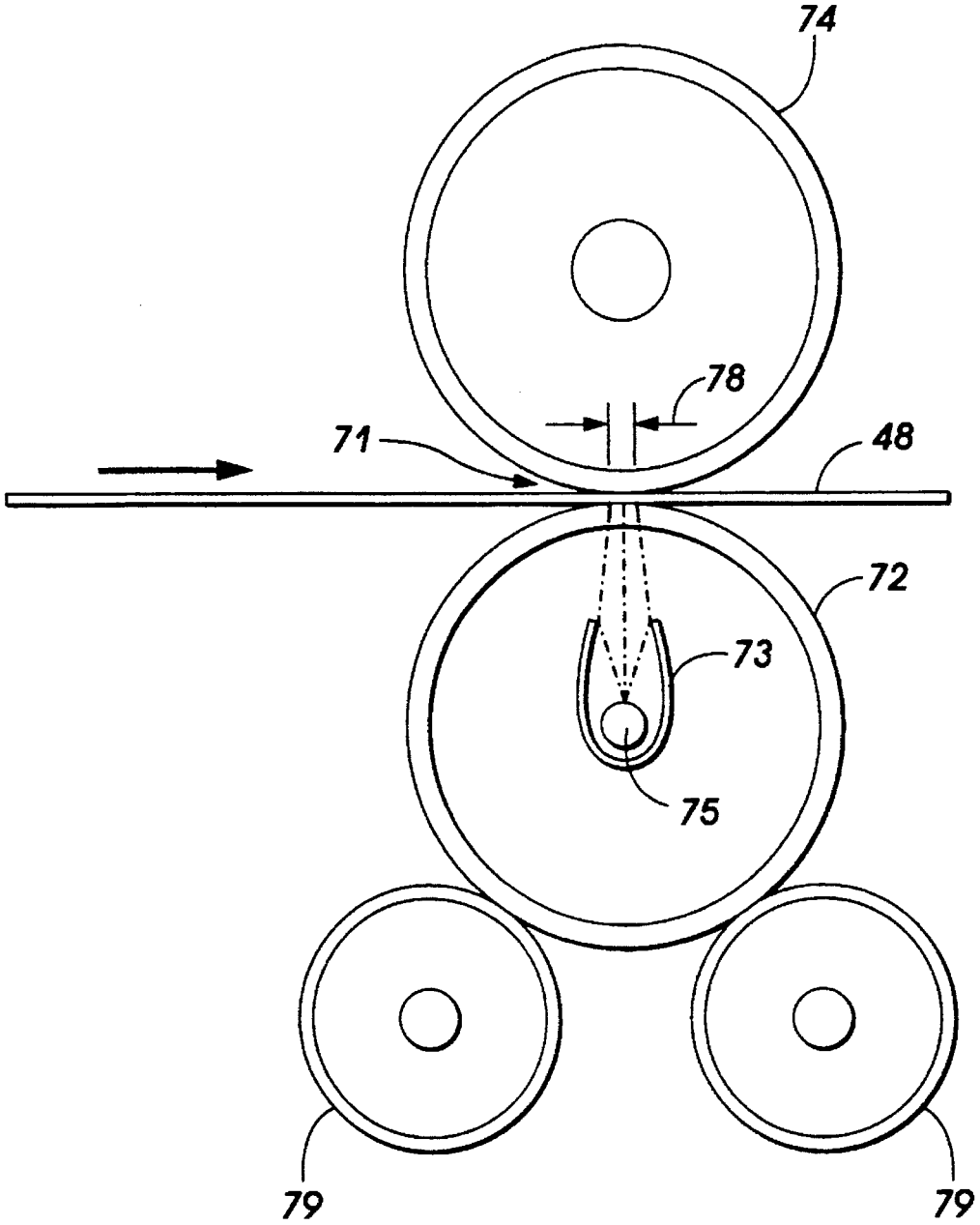
FIG. 6 is an end view of a fusing device as described herein further including a heat leveling member.

Since end bearings may be required, a three roll configuration with the glass roll fuser roll 72 in the middle and two support rolls 79 may be necessary to reduce the moments at the end (FIG. 6). A first order stress analysis indicates that for a one inch diameter roll with a one-half inch hole, the maximum tensile stress is circumferential at the roll surface with a value of 100 psi for a symmetrical load on the top and bottom of the roll of 30 pound per inch. This value of stress is far below the nominal tensional strength for glasses of 2,000 psi.

Figure 4:
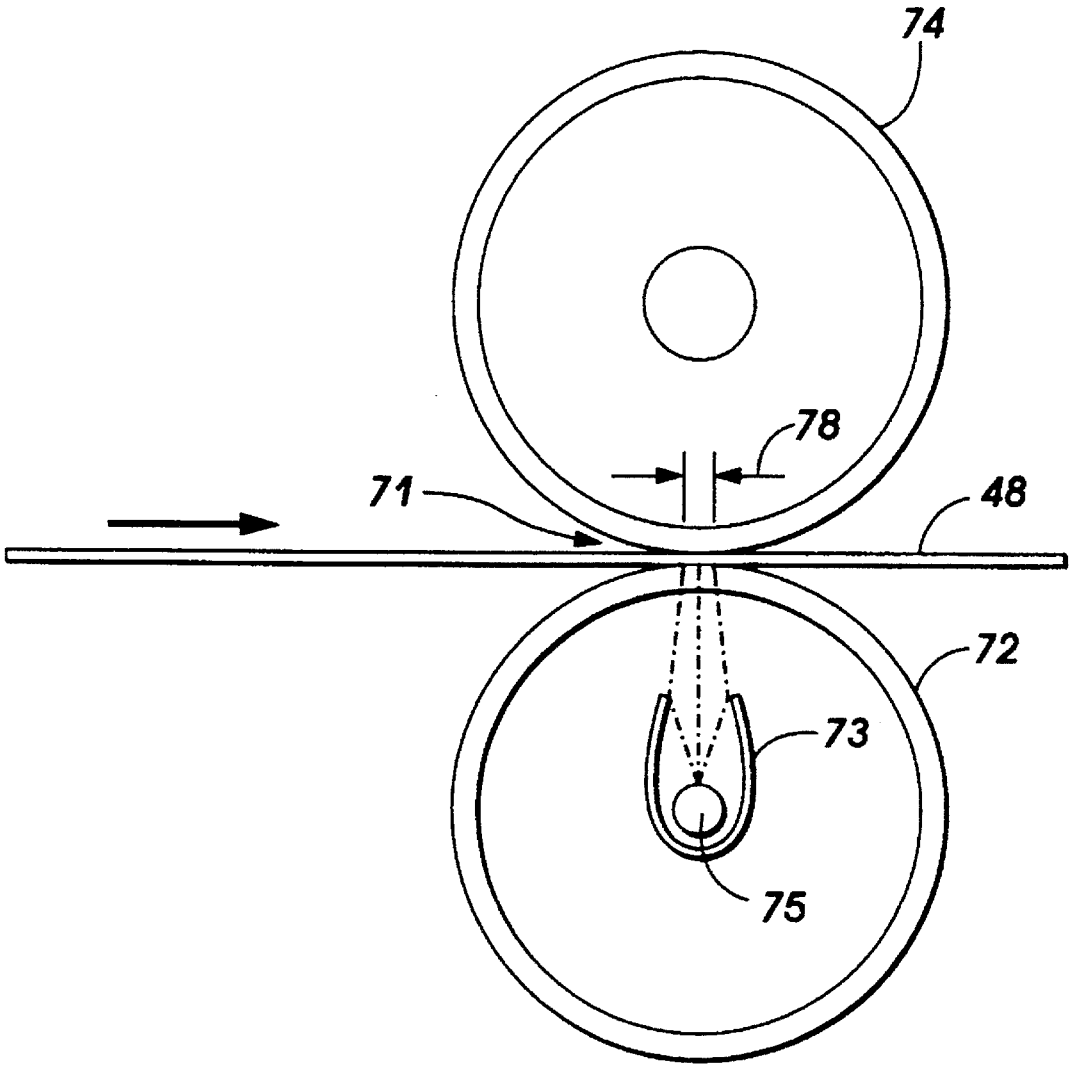
FIG. 4 is an end view of a fusing device as described herein.

FIG. 4 illustrates the basic configuration of the invention illustrating the transparent fuser roll 72, the heat lamp 73 within the fuser roll 72, and the elliptic focusing reflector 75 which focuses the heat from the heat lamp to the defined heating area 78 of the transparent fuser roll 72. There is a fractional loss of heat corresponding to the portion of the elipse which must be cut away to clear the roll. The pressure roll 74 is adjacent the transparent fuser roll 72 and forms a nip 71 therebetween which the paper 48 with the unfused toner passes through.

In a second embodiment of the fuser assembly of the present invention the outer surface of the pressure roll is provided with an optically absorbing layer of low thermal mass and high thermal diffusivity. The focal zone of the example quartz iodine lamp would be just up process from the fusing nip or within the fusing nip. The advantage of this coating is that the color of the image would not control the absorption of radiant heat from the lamp and images of any color would be successfully fused. The arrangement would retain the rapid warm up properties.

The disadvantage of this proposed scheme is that the transparent roll material must pass not only visible light, but substantial amounts of infrared radiation as well because the quartz iodine lamp emits a great deal of energy in this region. If it is desired to place a conformable layer near the outer surface, then this material too must be effectively transparent to infrared radiation. Quartz is the best rigid core material but probably is too expensive to be effective. Pyrex is a suitable substitute. Unfilled silicone rubbers, crosslinked polydimethyl silicones, are highly transparent to visible and infrared radiation and may be used to provide a conformable material on the fuser core. Other rubbers, having different mechanical and aging properties, however, may not be transparent to infra red radiation.

To cure the above problem, the inside of the quartz lamp should be coated with a layer of tin oxide or indium tin oxide of such composition to make it a heat mirror, that is, a reflector, for that portion of the infrared spectrum that would be absorbed by the parts of the fuser roll that are meant to be transparent. In this way, radiation that would be ineffective is returned to the lamp filament unless electrical energy is needed to keep it at operating temperature.

A further improvement on the above embodiment is a lateral smoothing device to maintain a fairly uniform temperature axially across the fuser roll. Thus is particularly useful for a wide fuser roll, i.e., 17 inches, through which narrower paper, i.e., 11 or 14 inches, is passing to prevent the ends of the fuser roll which do not contact the paper from overheating.

Figure 5:
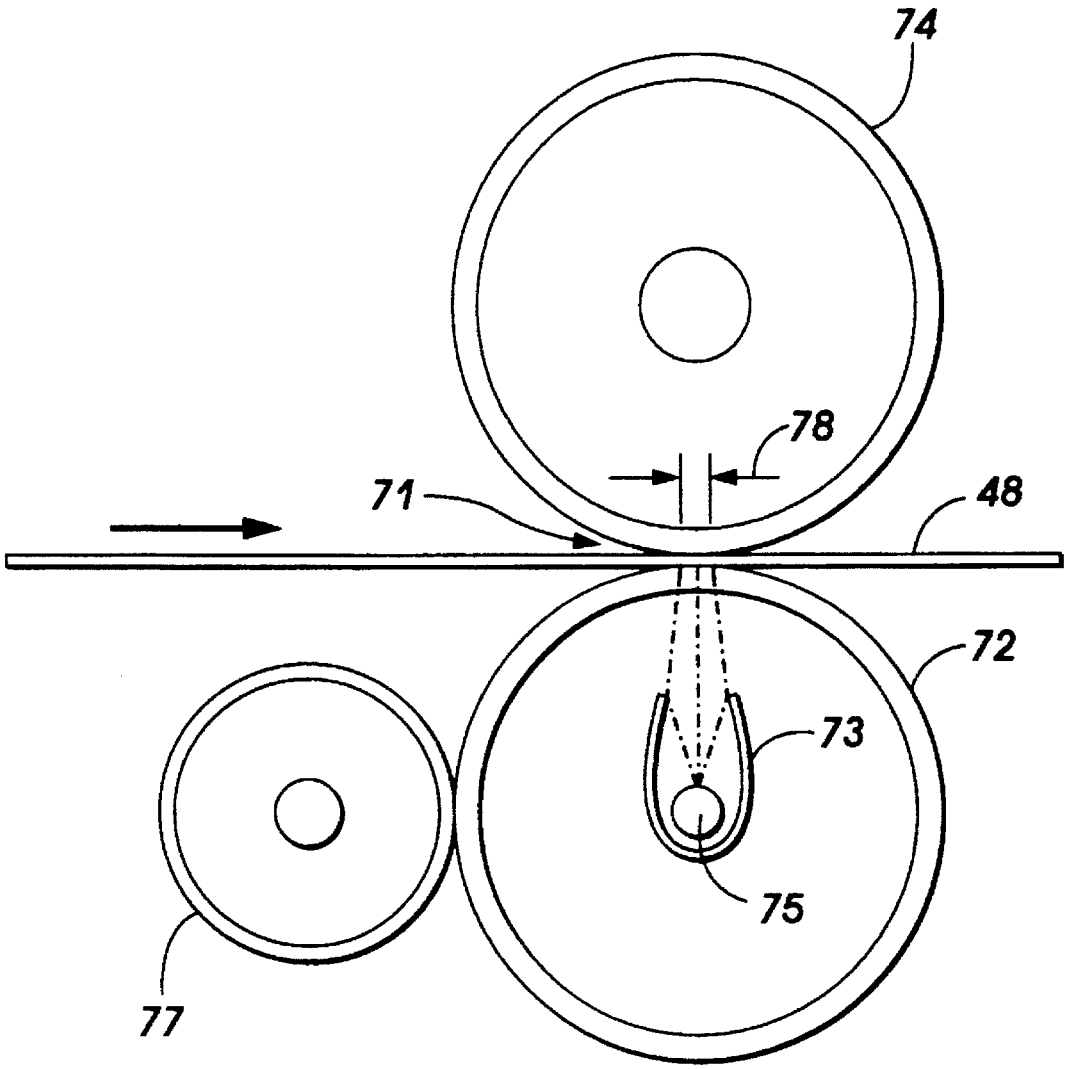
FIG. 5 is an end view of a second embodiment of a fusing device as described herein.

FIG. 5 illustrates an arrangement in which a thermally conductive temperature leveling roll 77 is shown in contact with the outside of the fuser roll 72. The thermal mass of the leveling roll 77 can be high. Just after wake up, fusing energy is supplied by the quartz lamp 73, as the run proceeds, the leveling roll 77 and the fuser roll core drift upward in temperature and reduce long run power requirements. It can be seen from this discussion that the invention proposed herein will provide a quick wake up instant on fuser that would be capable of maintaining a fairly constant heat axially along the fuser roll 72 and still giving the properties desired by a pressure roll contact fusing device. A phase change pressure roll such as that described in U.S. application Ser. No. 08/551,088, titled "Isothermalizing Member For a Printing Machine"filed on Oct. 31, 1995, Attorney Docket No. D/95362 and by one of the inventors hereto and commonly assigned to assignee herein is also a suitable device to provide axial temperature leveling along the fuser member.

In recapitulation, there is provided an apparatus for fusing images to a sheet. A fuser device is provided using a transparent fusing roll having an internal heating device which focuses radiant energy to a narrow area of the roll adjacent the nip formed with a pressure roll. A transparent fuser roll is used in a pressure nip fusing system to take advantage of the quick response of a focused lamp system while at the same time yielding the desirable image quality attributes of the pressure nip in two roll fusing. The focused lamp is completely enclosed and the heated region of the paper is within the nip contact region so there exists no possibility of igniting paper. A quick start up from cold start is possible so that no standby power is required.

It is, therefore, apparent that there has been provided in accordance with the present invention, a rapid wake up fuser system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for fusing images to a substrate, comprising:

a pressure member;

a heated transparent fusing member adjacent said pressure member and forming a nip therewith, said fusing member heated so that the heat energy is focused in a relatively narrow area adjacent the nip; and a heat leveling member in contact with said fusing member, said heat leveling member being adapted to transfer heat along a longitudinal axis of said fusing member so as to equalize the temperature therealong.

2. An apparatus according to claim 1 wherein said heat leveling member comprises a roll in contact with said fusing member, said roll having a high thermal conductivity.

3. An apparatus according to claim 1 wherein said heat leveling member comprises a roll adapted to move into and out of contact with said fusing member and control means to make or break contact depending on the temperature state of said fusing member.

4. An apparatus for fusing images to a substrate, comprising:

a pressure member; and a heated transparent fusing member adjacent said pressure member and forming a nip therewith, said fusing member heated so that the heat energy is focused in a relatively narrow area adjacent the nip, wherein said pressure member comprises a heat leveling member, said heat leveling member being adapted to transfer heat along a longitudinal axis of said fusing member so as to equalize the temperature therealong.

5. An apparatus according to claim 4, wherein said pressure member comprises a heat leveling member, said heat leveling member having a thermally conductive core and a coating having heat dissipation properties approximating those of a sheet of paper.

6. An apparatus according to claim 4, wherein said pressure member comprises a heat leveling member, said heat leveling member being adapted to have heat transfer properties approximating a cold sheet of paper.

7. A printing machine in which images are fused to a substrate comprising:

a pressure member;

a heated transparent fusing member adjacent said pressure member and forming a nip therewith, said fusing member heated so that the heat energy is focused in a relatively narrow area adjacent the nip; and a heat leveling member in contact with said fusing member, said heat leveling member being adapted to transfer heat along a longitudinal axis of said fusing member so as to equalize the temperature therealong.

8. A printing machine according to claim 7 wherein said heat leveling member comprises a roll in contact with said fusing member, said roll having a high thermal conductivity.

9. A printing machine according to claim 7 wherein said heat leveling member comprises a roll adapted to move into and out of contact with said fusing member and control means to make or break contact depending on the temperature state of said fusing member.

10. A printing machine in which images are fused to a substrate comprising:

a pressure member;

a heated transparent fusing member adjacent said pressure member and forming a nip therewith, said fusing member heated so that the heat energy is focused in a relatively narrow area adjacent the nip, wherein said pressure member comprises a heat leveling member, said heat leveling member being adapted to transfer heat along a longitudinal axis of said fusing member so as to equalize the temperature therealong.

11. A printing machine according to claim 10, wherein said pressure member comprises a heat leveling member, said heat leveling member having a thermally conductive core and a coating having heat dissipation properties approximating those of a sheet of paper.

12. A printing machine according to claim 10, wherein said pressure member comprises a heat leveling member, said heat leveling member being adapted to have heat transfer properties approximating a cold sheet of paper.

* * * * *